US005412925A

United States Patent [19]

Tani et al.

[11] Patent Number: 5,412,925

[45] Date of Patent: May 9, 1995

[54] METHOD AND APPARATUS FOR INSERTING A CORE PACKAGING LAYER INTO A CLEAN ENVIRONMENT

[75] Inventors: Kazunori Tani; Toshiaki Kimura, both of Tokyo, Japan

[73] Assignee: Y.A.C. Corporation, Tokyo, Japan

[21] Appl. No.: 212,535

[22] Filed: Mar. 14, 1994

[51] Int. Cl.[6] ..... B65B 9/00; B65B 55/02

[52] U.S. Cl. ..... 53/450; 156/249; 156/344; 493/374; 493/381; 53/425; 53/553; 53/555

[58] Field of Search ..... 53/140, 141, 425, 426, 53/433, 450, 451, 485, 550, 551, 552, 553, 554, 555; 493/193, 194, 374, 381; 156/249, 344, 556, 566, 584

[56] References Cited

U.S. PATENT DOCUMENTS

| | | | |
|---|---|---|---|
| 4,160,852 | 7/1979 | Torterotot | 53/426 |
| 5,194,109 | 3/1993 | Yamada | 156/344 |
| 5,358,591 | 10/1994 | Candore | 156/344 |

*Primary Examiner*—James F. Coan
*Assistant Examiner*—Gene Kim
*Attorney, Agent, or Firm*—Heller, Ehrman, White & McAuliffe

[57] ABSTRACT

A product required to be kept in a clean environment is packaged by removing outer layers of a multi-layer film and immediately thereafter introducing its inner core sheet inside a clean room. A bag with an opening is produced inside the clean room by superposing and sealing together two of such core sheets, by splitting one core sheet into two sub-layers and superposing and sealing together these two sub-layers or by folding one core sheet and superposing and sealing together its folded parts. The product may be packaged in such a bag either by using the same apparatus which makes the bag or by using another apparatus. The bag is made of a multi-layered material, and its outer layer is peeled off immediately before it is put inside a clean room to be torn apart and to have the produce taken out. Hollow wedges having air holes may be used to peel off outer layers from the core sheet while causing air to be emitted outward through these holes in order to prevent the core sheet from splitting while preventing both the outer layers and the core sheet from rubbing against the wedge surfaces. Such a hollow wedge may also be used for splitting a core sheet into two sub-layers.

22 Claims, 4 Drawing Sheets

METHOD AND APPARATUS FOR INSERTING A CORE PACKAGING LAYER INTO A CLEAN ENVIRONMENT

BACKGROUND OF THE INVENTION

This invention relates to methods of packaging a cleanness-requiring product and apparatus used for such clean packaging.

Products such as silicon wafers, magnetic disks and photomasks require a high level of cleanness. Products in biotechnologies, pharmaceutical products and medical devices must be kept in a sterilized condition. Thus, prior art methods of packaging such a product typically included the steps of washing and drying both surfaces of a film sheet inside a clean room and sealing edges of the sheet after a product to be packaged is enclosed therein.

If a product is wrapped inside only one layer of film, the outer surface of the package becomes contaminated with contaminants such as dust while, for example, it is transported and delivered to its user. If the film is of a conventional, non-peelable kind and such a package is opened inside a clean room, these contaminants remaining on its external surface are likely to contaminate the interior of the clean room, and the product, if it is taken out into this contaminated atmosphere, will itself become contaminated, although the opening of the package takes place inside the clean room. For this reason, a cleanness-requiring product is frequently packaged inside a double layer of film by wrapping it twice in a film or placed in two bags one inside the other.

The prior art methods described above are disadvantageous firstly because two separate bag-forming processes are required, and secondly because the film, which serves as the packaging material, must be washed and dried before it is formed into a bag, and this affects the productivity adversely. Since apparatus for washing and drying are additionally required, furthermore, the packaging machine becomes large as a whole, and the cost of installing and operating the machine also increases.

SUMMARY OF THE INVENTION

It is therefore an object of the invention to provide a method of clean packaging with high productivity without requiring a large apparatus or incurring a large expense.

It is another object of the invention to provide an apparatus for clean packaging which is relatively compact and can be installed and operated economically.

A method embodying the present invention, with which the above and other objects can be accomplished, may be characterized by the use of a multi-layer film with two outer layers sandwiching therebetween a core sheet which itself may or may not be of a multi-layered construction. Immediately after these two outer layers are peeled off, only the inner core sheet, which has been shielded and protected from contaminants by these outer layers, is introduced into a clean room for packaging a cleanness-requiring product. Thus, there is no need to wash or dry a packaging material, and productivity can be significantly improved over prior art methods. Since no separate devices for washing and drying are required, the method of this invention can be used by a packaging machine which is compact and hence is economical to install and operate.

A bag with an opening at one side for enveloping the product may be formed, for example, by superposing two of such multi-layered core sheets one over the other and using a three-side sealer of a known kind to seal them together along three sides, or by folding one such core sheet into two mutually overlapping pages and sealing them together along two sides thereof. In the former method, two sub-layers, each comprising at least two layers, separated from a single core sheet may be used, instead of two core sheets from two different multi-layer films. The placing of the product to be packaged inside the bag thus formed and the sealing of the bag thereafter may be accomplished either by means of an integrated packaging machine or separately from a bag-making machine.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
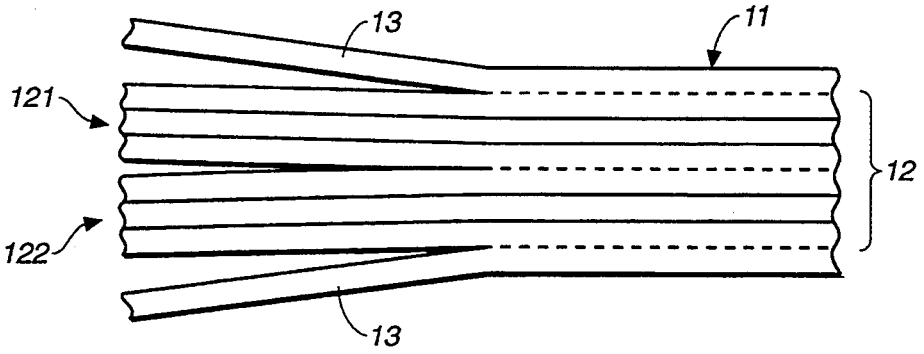
FIG. 1 is a schematic sectional view of an example of multi-layer film which can be used in a method according to the present invention.

A method according to the present invention is characterized as using a peelable multi-layer film with at least three layers as disclosed in Japanese Patent Publication Tokkai 62-9941. Such a film can be produced by using two kinds of resin materials having poor mutual adhesion with respect to each other and forming a multi-layer film by means of an extruding machine. In FIG. 1, such a multi-layer film 11 is sectionally shown schematically as having a core sheet 12 sandwiched between two outer layers 13. Dotted lines in FIG. 1 indicate boundaries between layers of resin materials with relatively poor mutual adhesion therebetween. In other words, these dotted lines indicate boundaries between the inner core sheet 12 and the outer layers 13, as well as boundaries at which the core sheet 12 itself may be later separated into sub-layers.

Figure 2:
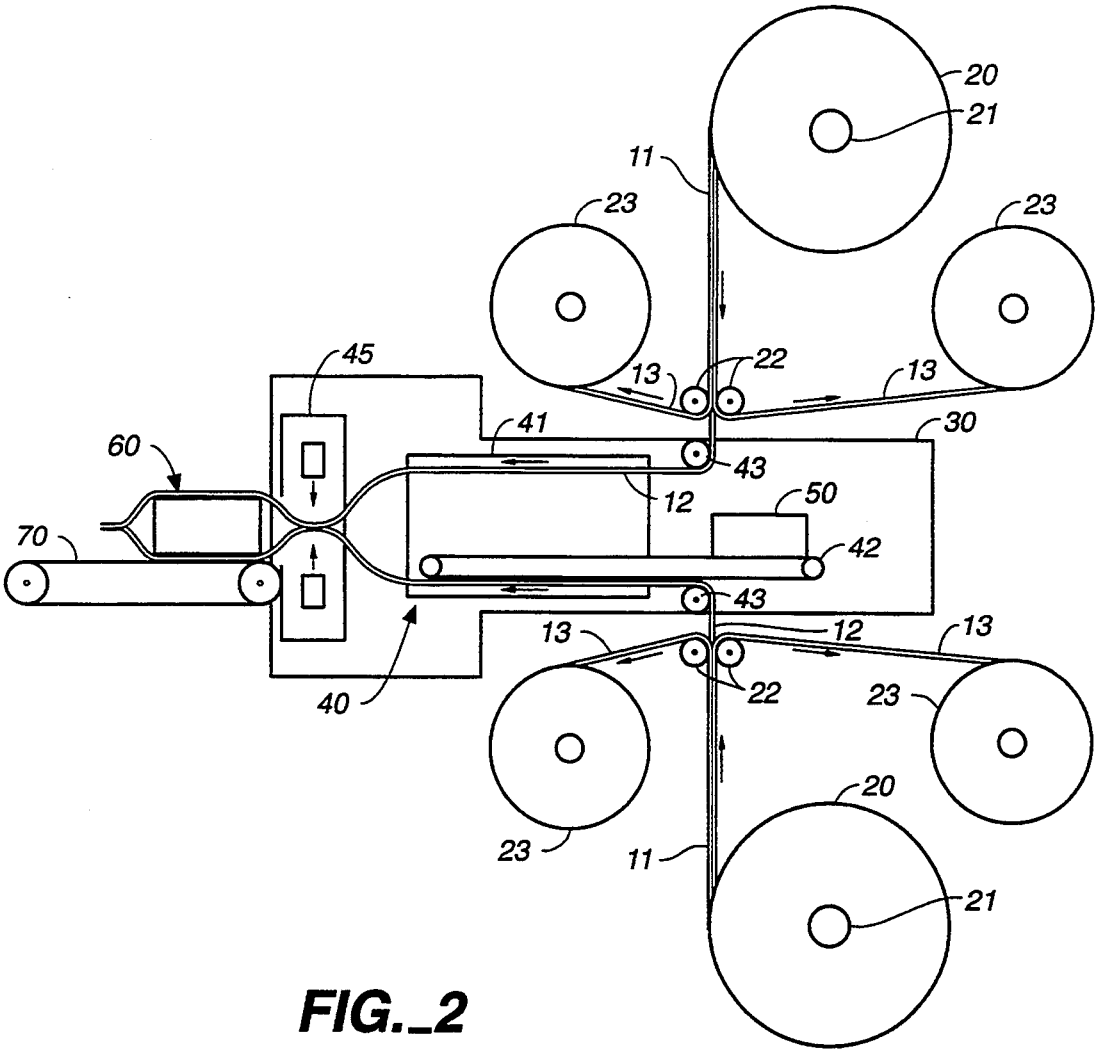
FIG. 2 is a schematic drawing of a packaging machine for using a method embodying the present invention.

In FIG. 2 which illustrates an apparatus for clean packaging by a method embodying the present invention, numerals 20 indicate a pair of rolls of such a multi-layer film 11 each supported by a rotatable shaft 21 disposed symmetrically above and below a clean room 30 providing a dust-free clean environment therein.

Webs of the film 11 are pulled out of these film rolls 20 towards the clean room 30, each web being passed between a pair of peeling rollers 22. Forward ends of the two outer layers 13 of each web of the film 11 are individually attached to and wound around a pair of take-up rollers 23. As these take-up rollers 23 are rotated, the film 11 is pulled out of the film roll 20, the outer layers 13 of the film 11, which are only weakly attached to the inner core sheet 12, are peeled off and separated from the core sheet 12, and only the core sheet 12 of the multi-layer film 11 is guided into the clean room 30 and into a bag-making device 40 disposed therein.

The bag-making device 40 includes a three-side sealer 41 and a conveyer belt 42. The directions of motion of the core sheets 12 of the films 11, pulled from the two film rolls 20 and from which the outer layers 13 have been removed, are changed by 90° by means of a pair of guide rollers 43 such that they move parallel to each other as they enter the three-side sealer 41. It is to be noted that the core sheet 12 of each multi-layer film 11 is shielded and protected from external contaminants before its outer layers 13 are peeled off and, as soon as the outer layers 13 of the films 11 are removed, the core sheets 12 are brought inside the clean room 30. Thus, the core sheets 12, as they are brought to the three-side sealer 41, are in a dust-free clean condition.

The three-side sealer 41 may be of a kind described, for example, in Japanese Patent Publication Tokko 3-14682 or Tokkai 1-63603, adapted to thermally seal together two sheets of thermally bondable film sheets placed one above the other (or generally parallel to each other) along their two side edges and a transverse edge generally in a U-shape so as to form a bag with an opening at one side. As a bag is formed from the two core sheets 12 of the films 11 by the three-side sealer 41, a product 50 to be packaged is transported into the bag by the conveyer belt 42 and deposited inside the bag.

The bag, thus formed and now containing therein the product 50 to be packaged, is pulled farther away from the guide rollers 43 and through an end sealer-cutter 45 by a mechanism (not shown), which may be considered a part of the three-side sealer 41. The end sealer-cutter 45 is a device of a known kind which serves not only to thermally seal the opening of the bag transversely with respect to the direction of its motion (towards the left in FIG. 2) such that the product 50 is now completely sealed (end sealing) in an air-tight manner inside a dust-free clean environment, but also to cut the web of the film 11 behind the line along which the end sealing has been effected. A packaged product 60 thus produced is removed by means of a discharge conveyor belt 70.

Figure 3:
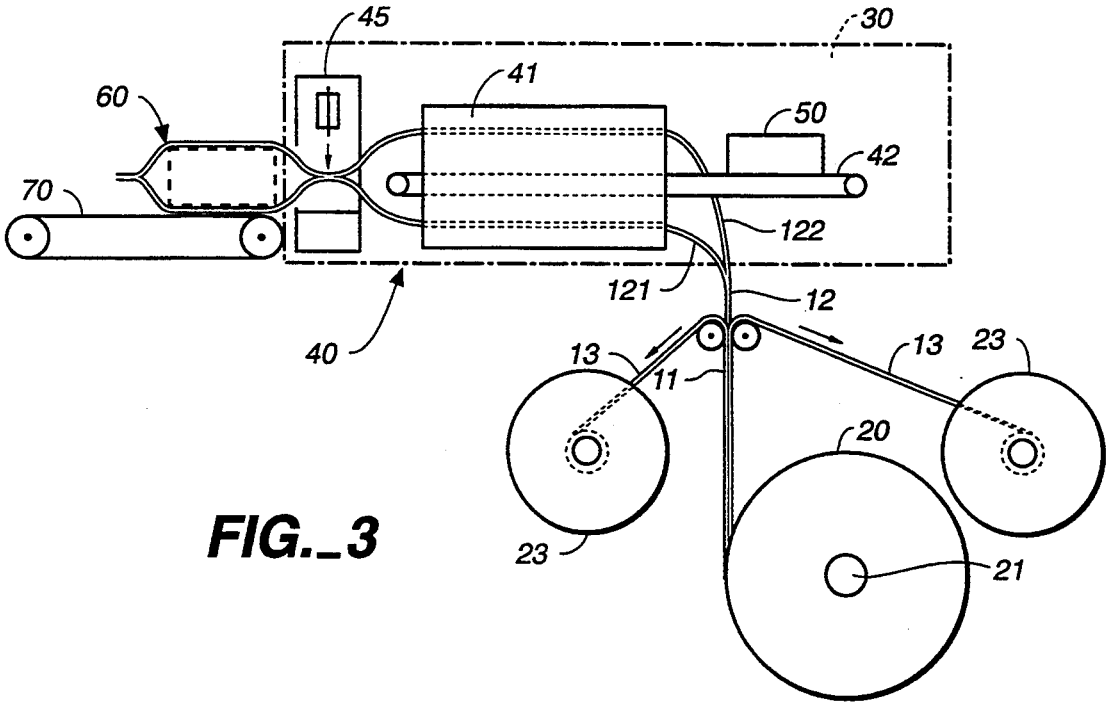
FIG. 3 is a schematic drawing of another packaging machine for using another method embodying the present invention.

The present invention has been described above with reference to only one example, but this example is not intended to limit the scope of the invention. Many modifications and variations are possible within the scope of the invention. For example, FIG. 3 shows another packaging machine embodying the present invention. For convenience, components shown in FIG. 3, which are the same as, or at least substantially similar to, a component shown in FIG. 2, are indicated by the same numeral and will not be explained anew.

The packaging machine shown in FIG. 3 is different from the one described above with reference to FIG. 2 in that use is made of only one roll 20 (instead of two) of multi-layer film 11 with its core sheet separable into two sub-layers 121 and 122. After the two outer layers 13 of this film 11 are peeled off by means of a pair of peeling rollers 22 and a pair of take-up rollers 23 as explained above, the core sheet 12 is separated into these two sub-layers 121 and 122, and they are separately introduced into the three-side sealer 41. The operations thereafter of the three-side sealer 41 and the end sealer-cutter 45 are the same as explained above with reference to FIG. 2.

The present invention is also intended to include within its scope methods of and apparatus for forming a clean bag, into which a cleanness-requiring product can be introduced and of which the opening is thereafter sealed to form a completely sealed package. An apparatus to be used for such a purpose may be substantially as described in FIGS. 2 and 3 except the end-sealer-cutter 45 is replaced by a simple cutter, and final products discharged from such an apparatus are not packaged products but clean bags with an opening at one side. Such clean bags may be used for packaging by means of a separate apparatus. Such a separate apparatus may be either an automatic or manually operated machine.

The bag-forming operation in the methods and apparatus according to the present invention need not be carried out by a three-side sealer. In other words, the three-side sealer 45 shown in FIGS. 2 and 3 may be replaced by a two-side sealer (not shown) of a known kind adapted to fold a film sheet and to seal along two edges, one parallel to and the other perpendicular to the line of folding, such that a bag with an opening at one side can be formed with the folding line of the film sheet serving as one of its side edges. If such a two-side sealer is used for the bag-forming operation, it now goes without saying that only one core sheet from one multi-layer film needs to be introduced into the clean room 30 and to the sealer.

A packaged product, produced by the methods described above embodying the present invention, may be characterized in that its bag itself is multi-layered such that its outer layers can be easily removed. When such a package is received by a user, its externally exposed outer surfaces are generally not expected to be clean. The outer layers of the bag are therefore removed and its content is immediately placed inside a clean room, inside which the inner layers of the bag are opened and the cleanness-requiring product is taken out therefrom within the clean environment of the clean room.

Figure 4:
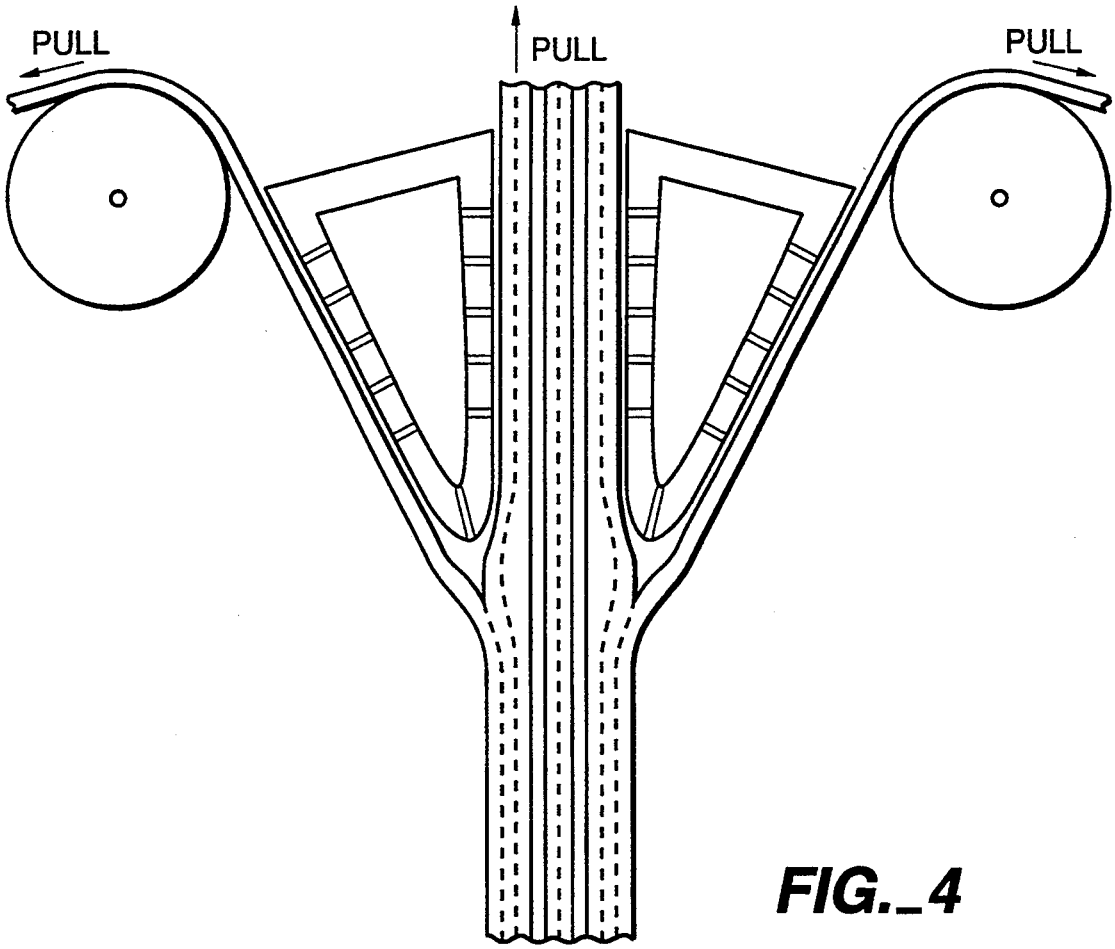
FIG. 4 shows a portion of FIGS. 2 and 3 with air wedges are used.

When use is made of a multi-layer film, such as shown in FIG. 1, with a core sheet 12 itself having a weak boundary between mutually separable sub-layers, it may be preferable to use means for preventing the core sheet 12 from splitting into such sub-layers when the outer layers 13 are being peeled off therefrom. FIG. 4 shows an example of such means (or air wedges) 25 placed between the pair of peeling rollers 22 and characterized as being each shaped like a wedge serving not only to separate one of the outer layers 13 from the core sheet 12 but also to keep the sub-layers of the core sheet 12 pressed inwardly toward each other. As better shown in FIG. 5, each air wedge 25 is hollow, and its wedge surfaces, as well as the front edge, are provided with many openings 26. The hollow interior of the air wedge 25 is connected to a source of ionized high-pressure clean air (not shown). Such high-pressure air is emitted outward through these openings 26 to prevent the film layers from contacting the wedge surfaces because such contacts tend to generate dust particles. Use is made of ionized air for preventing electrostatic charging of the film 11.

Figure 5:
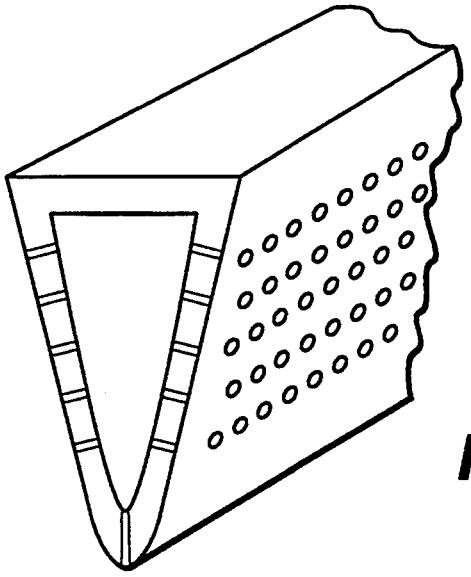
FIG. 5 is a diagonal view of the air wedge of FIG. 4.
Figure 6:
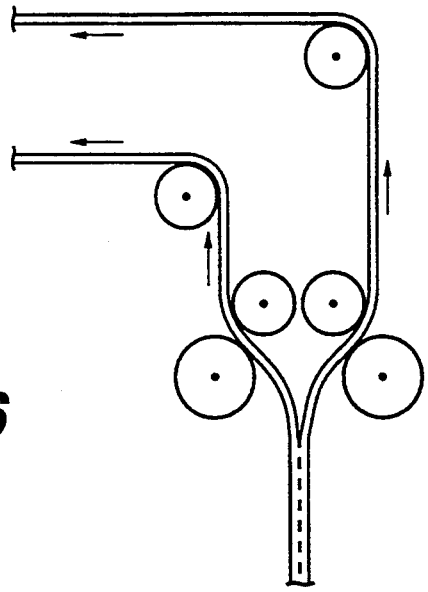
FIG. 6 is a schematic sectional view of a means for splitting the core sheet of a multi-layer film into two sub-layers.

FIG. 6 shows an improved means, which may be incorporated in the apparatus shown in FIG. 3, for splitting the core sheet 12 (for example, of a film of the type shown in FIG. 1 adapted to be split in the middle) into two sub-layers 121 and 122. It is characterized as comprising two pairs of mutually adjacent rollers 28*a* and 28*b*. Rollers 28*a* and 28*b* of each pair is separated from each other enough to pass one of the sub-layers 121 and 122, and the pairs are mutually separated such that a sufficient force is applied for peeling one of the sub-layers 121 or 122 from the other. Alternatively, an air wedge 26 of the type shown in FIG. 5 may be used for splitting the core sheet 12 into the two sub-layers 121 and 122.

In situations where, for example, the multi-layer film 11 has itself been produced inside a reasonably clean environment and its outer surfaces may not unreasonably contaminate the interior of the clean room 30, bags may be produced therefrom, within the scope of this invention, without first removing one of its outer layers 13. Use may be made of films with layer structure schematically shown in FIG. 8 on an apparatus as shown in FIG. 2 except the take-up rollers 23 on the left-hand side of the pairs are not required. Thus, the three-side sealer 41 as shown in FIG. 2 produces a bag of which the outer surfaces consist of outer layers 13 of the films 11 and the inner surfaces consist of their core sheets 12 in a cleaner condition than the outer surfaces.

Figure 7:
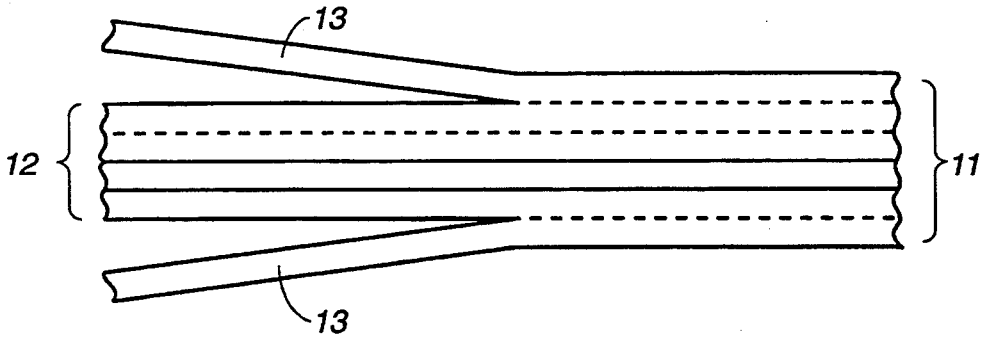
FIG. 7 is a schematic sectional view of another kind of multi-layer film which may be used according to the present invention.
Figure 8:
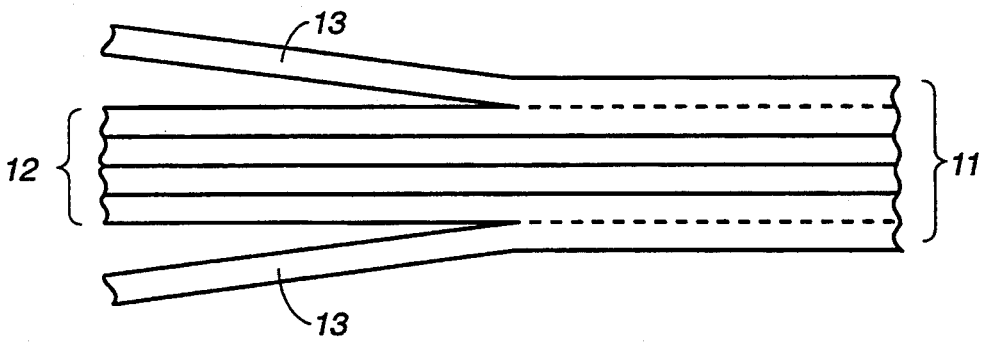
FIG. 8 is a schematic sectional view of still another kind of multi-layer film which may be used according to the present invention.

Likewise, use may be made of a film as shown in FIG. 7 or 8 with an apparatus as shown in FIG. 3 except neither of the take-up rollers 23 is required. The film 11 is split into two sub-layers each having one of the outer layers 13 remaining attached thereto. For this purpose, use may be made of an apparatus as shown in FIG. 6 or an air wedge as shown in FIG. 5. This method is also practical if the outer surfaces of the film 11 are reasonably clean to start with, and will not unreasonably contaminate the interior of the clean room 30 when it is brought thereinto.

In summary, methods according to the present invention are advantageous in that a cleanness-requiring product need not be wrapped in two bags one inside the other, and can still be made available in the same level of cleanness which was previous attainable only by packaging it in two bags as explained above. As a result, the required numbers of packaging machines and operators can be significantly reduced and, if use is to be made of an automatic packaging machine, the size and the cost of the required machine will also be reduced significantly.

The description of the invention given above is intended to be interpreted as broadly as reasonable. For example, the clean room need not be a sealed enclosure. It is intended to include a space of any size, enclosed or open, in which the level of cleanness is being kept above a certain desired level. All modifications and variations of the methods and apparatus described above, that may be apparent to a person skilled in the art, are intended to be within the scope of the invention.

What is claimed is:

1. A method of clean packaging comprising the steps of:

providing a multi-layer film with two peelable outer layers and a multi-layer core sheet sandwiched between said outer layers;

peeling at least one of said outer layers off said core sheet;

immediately thereafter introducing said core sheet inside a clean room means for providing a dust-free clean environment; and producing a bag with an opening from said core sheet inside said clean environment.

2. The method of claim 1 further comprising the steps of placing a cleanness-requiring product inside said bag through said opening and thereafter sealing said opening.

3. The method of claim 1 wherein said peeling step comprises the steps of:

causing said film to pass in an incoming direction between a mutually adjacent pair of peeling rollers; and causing one or both of said outer layers to be pulled away from said core sheet by pulling said one or both outer layers transversely to said incoming direction such that said one or both outer layers are removed from said core sheet each by moving in contact with and around one of said peeling rollers.

4. The method of claim 3 wherein said peeling step further comprises the step of attaching forward end or ends of said one or both outer layers to one or both of a pair of take-up rollers which are disposed transversely away from said peeling rollers.

5. The method of claim 1 further comprising the steps of:

providing another similarly structured multi-layer film;

peeling one or both of the outer layers off said another multi-layer film; and immediately thereafter introducing the core sheet of said another multi-layer film inside said clean room means;

said producing step comprising superposing and sealing together the two core sheets from said film and said another film.

6. The method of claim 2 further comprising the steps of:

providing another similarly structured multi-layer film;

peeling one or both of the outer layers off said another multi-layer film; and immediately thereafter introducing the core sheet of said another multi-layer film inside said clean room means;

said producing step comprising superposing and sealing together the two core sheets from said film and said another film.

7. The method of claim 1 further comprising the step of splitting said core sheet into two sub-layers, said producing step comprising superposing and sealing together said sub-layers.

8. The method of claim 2 further comprising the step of splitting said core sheet into two sub-layers, said producing step comprising superposing and sealing together said sub-layers.

9. The method of claim 1 wherein said producing step comprises folding said core sheet and sealing together folded parts thereof.

10. The method of claim 2 wherein said producing step comprises folding said core sheet and sealing together folded parts thereof.

11. An apparatus for clean packaging comprising:

a film supplying means for providing a multi-layer film;

a clean room means for providing a dust-free clean environment;

a peeling means for peeling at least one of outer layers off said film and immediately thereafter introducing a core sheet sandwiched between said outer layers of said film into said clean room means while keeping said outer layers from entering said clean room means; and a bag-making means disposed inside said clean room means for producing a bag with an opening from said core sheet.

12. The apparatus of claim 11 further comprising packaging means for introducing a cleanness-requiring product through said opening into said bag and thereafter sealing said opening.

13. The apparatus of claim 11 wherein said film supplying means includes a rotatably supported shaft around which said multi-layer film is wound and said peeling means includes a mutually adjacent pair of peeling rollers between which said multi-layer film is adapted to pass and one or two take-up rollers each adapted to take up by winding therearound one of said outer layers after said multi-layer film passes between said peeling rollers.

14. The apparatus of claim 12 wherein said film supplying means includes a rotatably supported shaft around which said multi-layer film is wound and said peeling means includes a mutually adjacent pair of peeling rollers between which said multi-layer film is adapted to pass and one or two take-up rollers each adapted to take up by winding therearound one of said outer layers after said multi-layer film passes between said peeling rollers.

15. The apparatus of claim 11 wherein:

said film supplying means supplies two similarly structured multi-layer films; and said peeling means being adapted to peel outer layers off both said two films and immediately thereafter to introduce the core sheets of both said films into said clean room means.

16. The apparatus of claim 12 wherein:

said film supplying means supplies two similarly structured multi-layer films;

said peeling means being adapted to peel outer layers off both said two films and immediately thereafter to introduce the core sheets of both said films into said clean room means; and said bag-making means is adapted to superpose and seal together the two core sheets from said two films.

17. The apparatus of claim 11 wherein said bag-making means is adapted to split said core sheet into two sub-layers.

18. The apparatus of claim 12 wherein said bag-making means is adapted to split said core sheet into two sub-layers, and to superpose and seal together said two sub-layers.

19. The apparatus of claim 11 wherein said bag-making means is adapted to fold said core sheet and to seal together two folded parts thereof.

20. The apparatus of claim 12 wherein said bag-making means is adapted to fold said core sheet and to seal together two folded parts thereof.

21. The apparatus of claim 13 wherein said peeling means includes hollow wedges each having many air holes and disposed near said peeling rollers.

22. The apparatus of claim 11 further comprising a hollow wedge having many air holes, said wedge being disposed between said peeling means and said bag-making means and serving to split said core sheet into two sub-layers.

* * * * *